US008678853B2

(12) United States Patent
Tai et al.

(10) Patent No.: US 8,678,853 B2
(45) Date of Patent: Mar. 25, 2014

(54) CABLE CONNECTOR ASSEMBLY WITH RELIABLE CONNECTION

(75) Inventors: Hung-Chi Tai, Jhonghe (TW); Yong-Gang Zhang, Taicang (CN)

(73) Assignee: Alltop Electronics (Suzhou) Co., Ltd, JiangSu Taicang (CN)

( * ) Notice: Subject to any disclaimer, the term of this patent is extended or adjusted under 35 U.S.C. 154(b) by 18 days.

(21) Appl. No.: 13/585,461

(22) Filed: Aug. 14, 2012

(65) Prior Publication Data

US 2013/0323961 A1 Dec. 5, 2013

(30) Foreign Application Priority Data

May 30, 2012 (CN) ..... 2012 1 0172381

(51) Int. Cl.
*H01R 11/20* (2006.01)

(52) U.S. Cl.
USPC ..... 439/404

(58) Field of Classification Search
USPC ..... 439/395, 404, 607.41
See application file for complete search history.

(56) References Cited

U.S. PATENT DOCUMENTS 7,393,235 B2 * 7/2008 Lin ..... 439/391
7,422,488 B1 * 9/2008 Wu ..... 439/676
7,534,141 B1 * 5/2009 Wu ..... 439/607.01
7,534,143 B1 * 5/2009 Tsao et al. ..... 439/607.41
7,540,786 B1 * 6/2009 Koser et al. ..... 439/660
7,572,071 B1 * 8/2009 Wu ..... 385/94
7,618,293 B2 * 11/2009 Wu ..... 439/660
7,717,733 B1 * 5/2010 Yi et al. ..... 439/452
7,798,850 B2 * 9/2010 Sabo et al. ..... 439/607.01
7,850,465 B1 * 12/2010 Wan et al. ..... 439/79
7,896,559 B2 * 3/2011 Yi et al. ..... 385/75
7,909,653 B1 * 3/2011 Wan et al. ..... 439/660
7,938,659 B1 * 5/2011 Zhu et al. ..... 439/218
7,942,704 B2 * 5/2011 Ko et al. ..... 439/660
7,946,893 B2 * 5/2011 Chen et al. ..... 439/660
8,052,431 B1 * 11/2011 He et al. ..... 439/78
8,052,477 B1 * 11/2011 Ko ..... 439/660
8,083,546 B2 * 12/2011 Lee ..... 439/607.02
8,123,558 B2 * 2/2012 Su et al. ..... 439/607.01
8,133,079 B2 * 3/2012 He ..... 439/660
8,152,569 B2 * 4/2012 Chen et al. ..... 439/660
8,215,996 B2 * 7/2012 Su et al. ..... 439/660
8,262,296 B2 * 9/2012 Liao et al. ..... 385/90
8,267,703 B2 * 9/2012 Yao et al. ..... 439/79
8,303,329 B2 * 11/2012 Wu ..... 439/395
8,308,376 B2 * 11/2012 Liao et al. ..... 385/92
8,398,427 B2 * 3/2013 Wu ..... 439/497
8,439,575 B2 * 5/2013 He et al. ..... 385/53
2007/0270022 A1 * 11/2007 Lin ..... 439/425
2008/0311801 A1 * 12/2008 Chen et al. ..... 439/733.1
2009/0117784 A1 * 5/2009 Wu ..... 439/660
2009/0117785 A1 * 5/2009 Wu ..... 439/668

(Continued)

*Primary Examiner* — Ross Gushi
(74) *Attorney, Agent, or Firm* — Sughrue Mion, PLLC

(57) ABSTRACT

A cable connector assembly includes a housing including a main portion and a mating portion extending forwardly from the main portion, a number of contacts received in the housing and including first contacts and second contacts; a number of first wires connecting with the first contacts; and a number of second wires connecting with the second contacts. Each first contact includes a first contacting section and a first termination section exposed beyond the housing. Each second contact includes a second contacting section and a second termination section exposed beyond the housing. The first termination section electrically connects with corresponding first wire via Insulation Displacement Connection (IDC). The second termination section electrically connects with corresponding second wire via soldering.

15 Claims, 7 Drawing Sheets

(56) References Cited

U.S. PATENT DOCUMENTS

| | | | | |
|---|---|---|---|---|
| 2009/0130906 | A1* | 5/2009 | Tsao et al. | 439/626 |
| 2010/0055980 | A1* | 3/2010 | Chen et al. | 439/607.01 |
| 2010/0124395 | A1* | 5/2010 | Lin et al. | 385/76 |
| 2010/0124845 | A1* | 5/2010 | Sabo et al. | 439/607.01 |
| 2010/0144202 | A1* | 6/2010 | Yi et al. | 439/607.06 |
| 2010/0159751 | A1* | 6/2010 | Chiu et al. | 439/660 |
| 2010/0290743 | A1* | 11/2010 | Liao et al. | 385/75 |
| 2010/0290745 | A1* | 11/2010 | Liao et al. | 385/90 |
| 2011/0021043 | A1* | 1/2011 | Lee | 439/78 |
| 2011/0053414 | A1* | 3/2011 | Wan et al. | 439/607.01 |
| 2011/0070778 | A1* | 3/2011 | Wan et al. | 439/660 |
| 2011/0091160 | A1* | 4/2011 | He et al. | 385/74 |
| 2011/0142399 | A1* | 6/2011 | Little et al. | 385/76 |
| 2011/0244733 | A1* | 10/2011 | Ueda et al. | 439/660 |
| 2011/0250783 | A1* | 10/2011 | Su et al. | 439/404 |
| 2011/0256756 | A1* | 10/2011 | Lu et al. | 439/449 |
| 2011/0256764 | A1* | 10/2011 | Wu | 439/607.01 |
| 2011/0263156 | A1* | 10/2011 | Ko | 439/607.01 |
| 2011/0269322 | A1* | 11/2011 | He et al. | 439/78 |
| 2011/0281469 | A1* | 11/2011 | Su et al. | 439/660 |
| 2011/0294339 | A1* | 12/2011 | Wu | 439/391 |
| 2011/0299816 | A1* | 12/2011 | Yen et al. | 385/89 |
| 2012/0009811 | A1* | 1/2012 | He et al. | 439/345 |
| 2012/0020624 | A1* | 1/2012 | Liao et al. | 385/77 |
| 2012/0021646 | A1* | 1/2012 | Su et al. | 439/607.01 |
| 2012/0040567 | A1* | 2/2012 | Ho | 439/660 |
| 2012/0045934 | A1* | 2/2012 | Wu | 439/607.01 |
| 2012/0071022 | A1* | 3/2012 | Su et al. | 439/449 |
| 2013/0040491 | A1* | 2/2013 | Wu | 439/607.01 |
| 2013/0040492 | A1* | 2/2013 | Wu | 439/607.55 |
| 2013/0078858 | A1* | 3/2013 | Wu et al. | 439/607.41 |
| 2013/0109238 | A1* | 5/2013 | Li et al. | 439/625 |
| 2013/0109242 | A1* | 5/2013 | Li et al. | 439/660 |
| 2013/0164990 | A1* | 6/2013 | Tsai | 439/660 |
| 2013/0203283 | A1* | 8/2013 | Tai et al. | 439/404 |

* cited by examiner

CABLE CONNECTOR ASSEMBLY WITH RELIABLE CONNECTION

BACKGROUND OF THE INVENTION

1. Field of the Invention

The present invention relates to a cable connector assembly, more particularly to a cable connector assembly complying with USB 3.0 protocol.

2. Description of Related Art

A conventional USB cable connector assembly, is usually used for a laptop computer. With the development of the technology, the laptop computer become minimized in volume, thus, the USB connectors used in the laptop computer also become minimized in volume.

The conventional USB cable connector assembly use round cables according to the requirements of the USB institute, the arrangement of the wires in the round cables also needs to meet the requirement of the institute. However, round cables increase the total height of the USB cable connector assembly, thus not satisfy the current miniaturization trend.

Hence, it is necessary to improve the conventional USB cable connector assembly to address problems mentioned above.

BRIEF SUMMARY OF THE INVENTION

Accordingly, an object of the present invention is to provide a cable connector assembly which is simple in structure and easy to be manufactured.

In order to achieve the above-mentioned object, a cable connector assembly comprises an insulative housing comprising a main portion and a mating portion extending forwardly from the main portion, a plurality of conductive contacts received in the insulative housing and comprising a plurality of first contacts and a plurality of second contacts; a plurality of first wires electrically connecting with the first contacts; and a plurality of second wires electrically connecting with the second contacts. Each first contact comprises a first contacting section for electrically connecting with a complementary connector and a first termination section exposed beyond the insulative housing. Each second contact comprises a second contacting section adapted for electrically connecting with the complementary connector and a second termination section exposed beyond the insulative housing. The first termination section of the first contact electrically connects with corresponding first wire via Insulation Displacement Connection (IDC). The second termination section of the second contact electrically connects with corresponding second wire via soldering.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
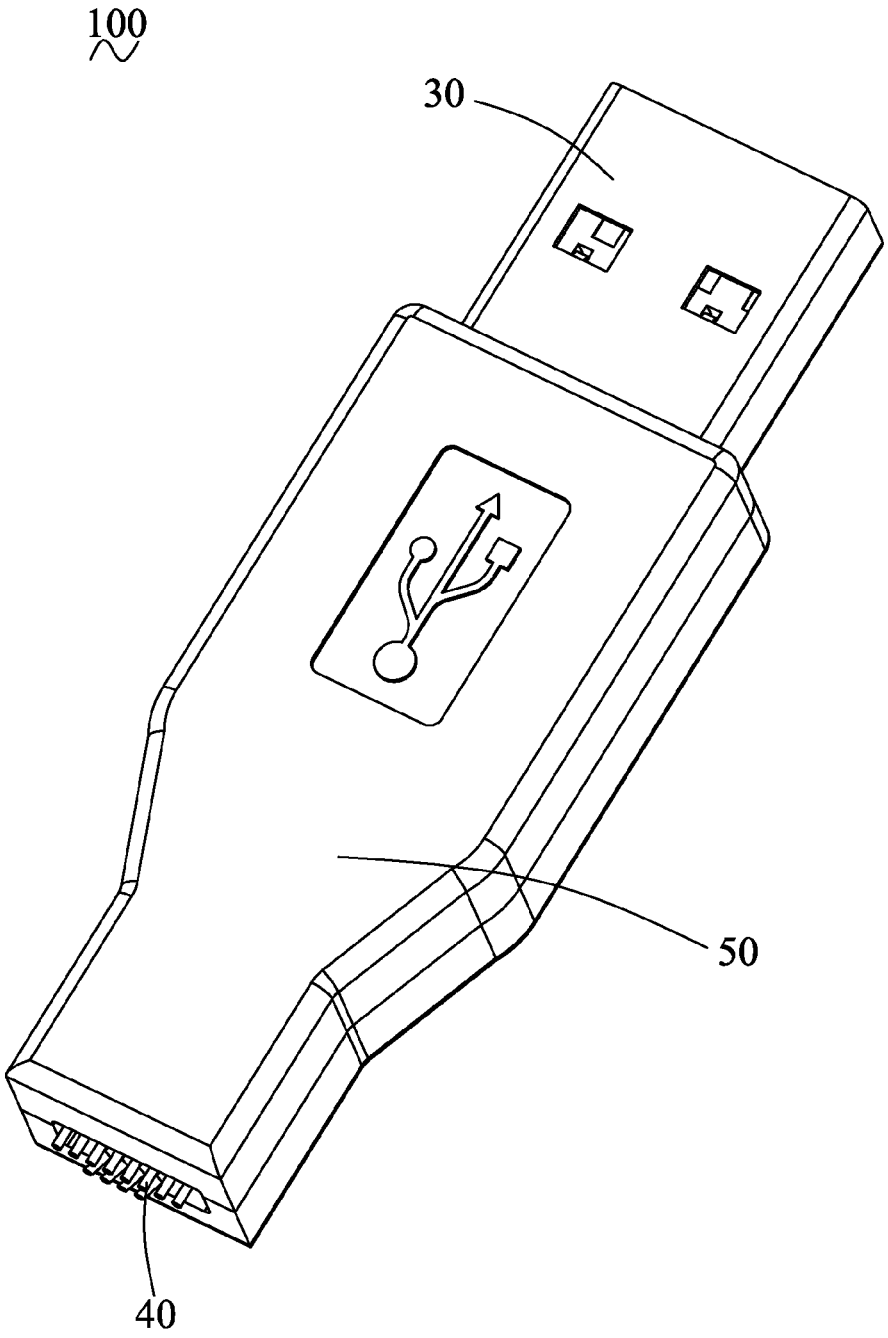
FIG. 1 is an assembled, perspective view of a cable connector assembly in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
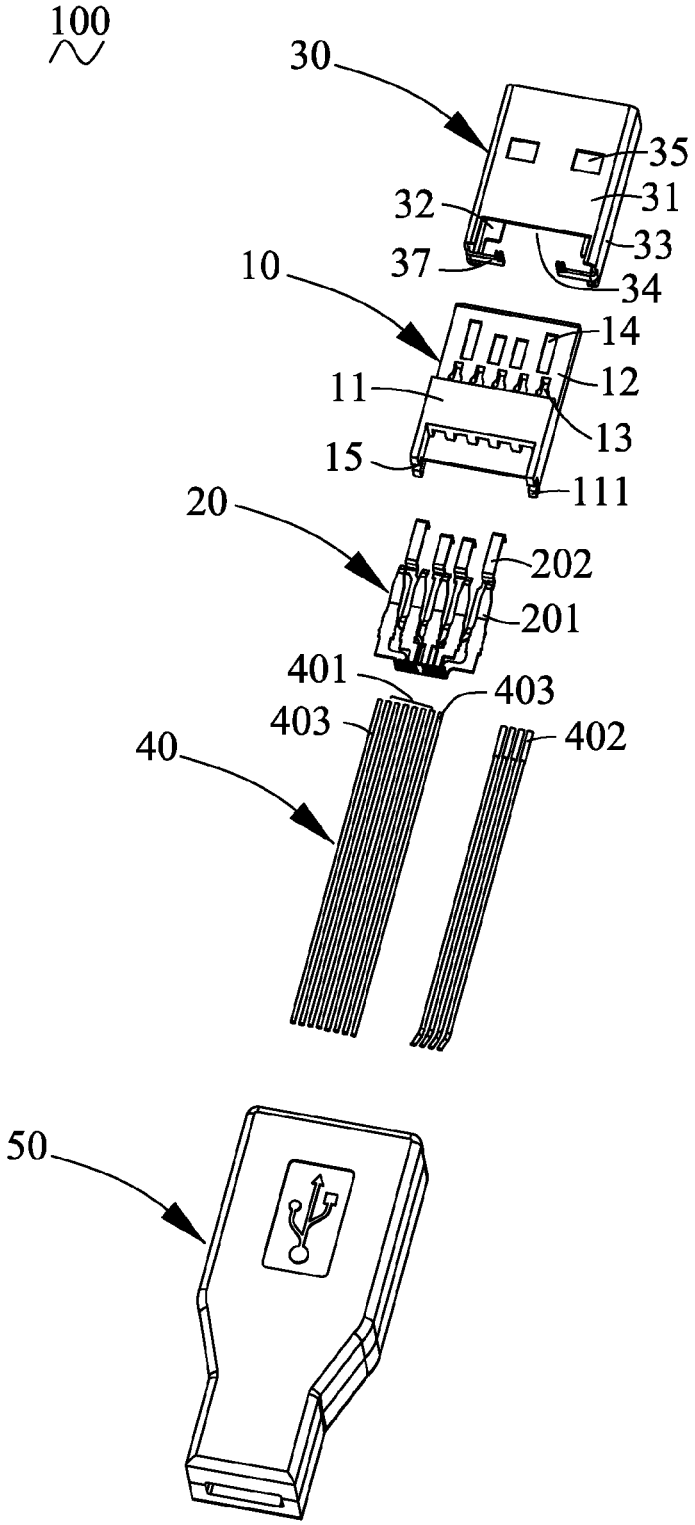
FIG. 2 is an exploded, perspective view of the cable connector assembly of FIG. 1.

Please refer to FIGS. 1-2, a cable connector assembly 100 in accordance with the present invention comprises an insulative housing 10, a plurality of conductive contacts 20 retained in the insulative housing 10, an outer shell 30 enclosing the insulative housing 10 and the conductive contact 20, a plurality of wires 40 electrically connecting with the conductive contacts 20, and a plastic casing 50 enclosing the wires 40. The conductive contacts 20 comprise a plurality of first contacts 201 and a plurality of second contacts 202 alternatively disposed with the first contacts 201. The wires 40 comprise a plurality of first wires 401 electrically connecting with the first contacts 201, a plurality of second wires 402 electrically connecting with the second contacts 202, and a pair of third wires 403 located at opposite outer sides of the first wires 401 and electrically connecting with the outer shell 30.

Figure 3:
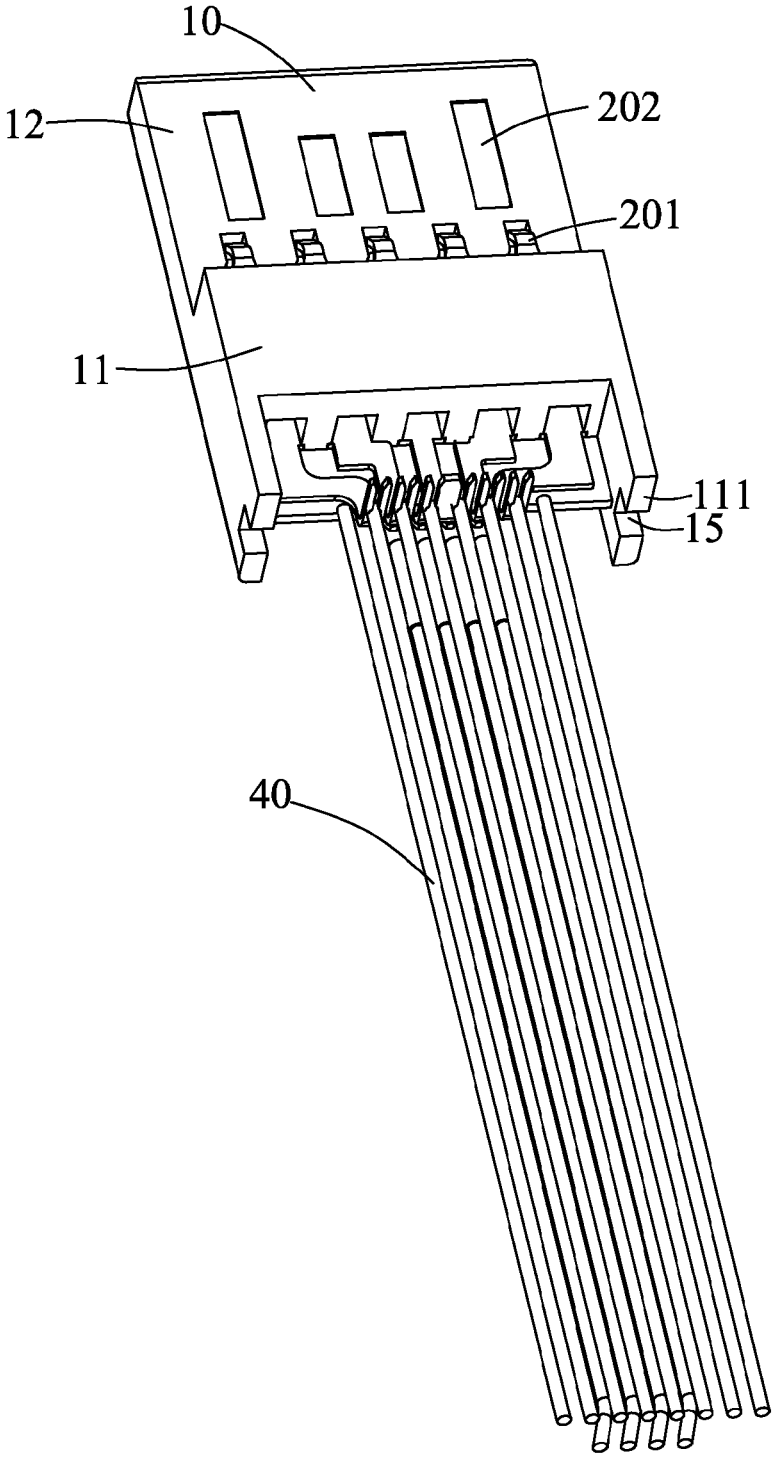
FIG. 3 is a partially assembled view of an insulative housing, conductive contacts and wires of the cable connector assembly shown in FIG. 2.
Figure 4:
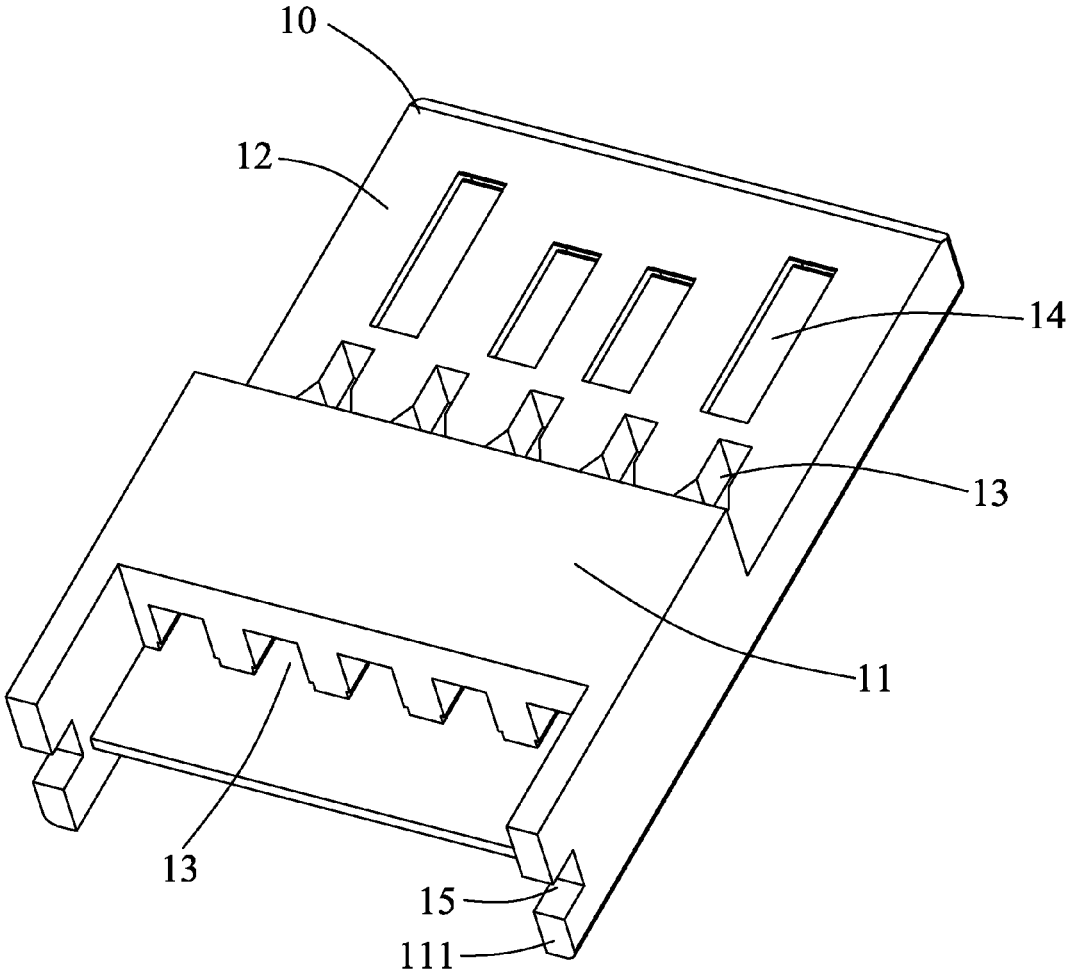
FIG. 4 is a perspective view of the insulative housing of the cable connector assembly shown in FIG. 2.
Figure 5:
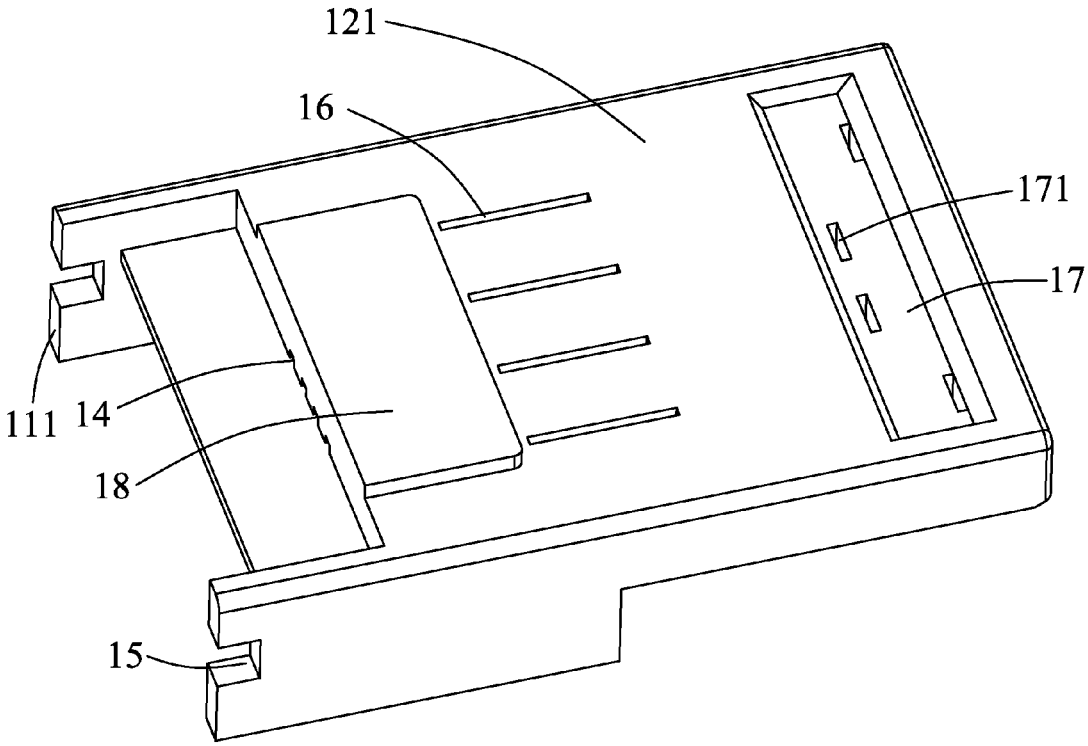
FIG. 5 is a view similar to FIG. 4, but from a different view.

Please refer to FIGS. 4-5 in conjunction with FIG. 3, the insulative housing 10 comprises a main portion 11 and a mating portion 12 extending forwardly from the main portion 11. The insulative housing 10 also defines a plurality of first receiving slots 13 for receiving the first contacts 201 and a plurality of second receiving slots 14 for receiving the second contacts 202. The first receiving slots 13 and the second receiving slots 14 are arranged alternatively. In the preferred embodiment of the present invention, since the configuration of the first contact 201 is different from that of the second contact 202, the configuration of the first receiving slot 13 is also different from that of the second receiving slot 14.

The first receiving slot 13 penetrates through the main portion 11 of the insulative housing 10 along the insertion direction of the first contact 201, and the second receiving slot 14 extends from a front edge of the main portion 11 till the mating portion 12 along the insertion direction of the second contact 202. The mating portion 12 also defines a plurality of heat-radiating slits 16 communicating with the second receiving slots 14 and penetrating through the mating portion 12. Via the cooperation between the heat-radiating slits 16 and the second contacts 202, the heat generated by the second contacts 202 in the second receiving slots 14 is capable of being radiated out in time.

In the preferred embodiment of the present invention, the main portion 11 defines a pair of notches 15 recessed r from a rear surface 111 thereof for cooperating with the outer shell 30, and a recess 17 recessed upwardly from a lower surface 121 thereof and communicating with the second receiving slots 14. The lower surface 121 also forms a protruding platform 18 for cooperating with the outer shell 30. The second contacts 202 also partially exposed into the recess 17 via a plurality of through slits 171 defined in the recess 17 for heat radiation.

Figure 6:
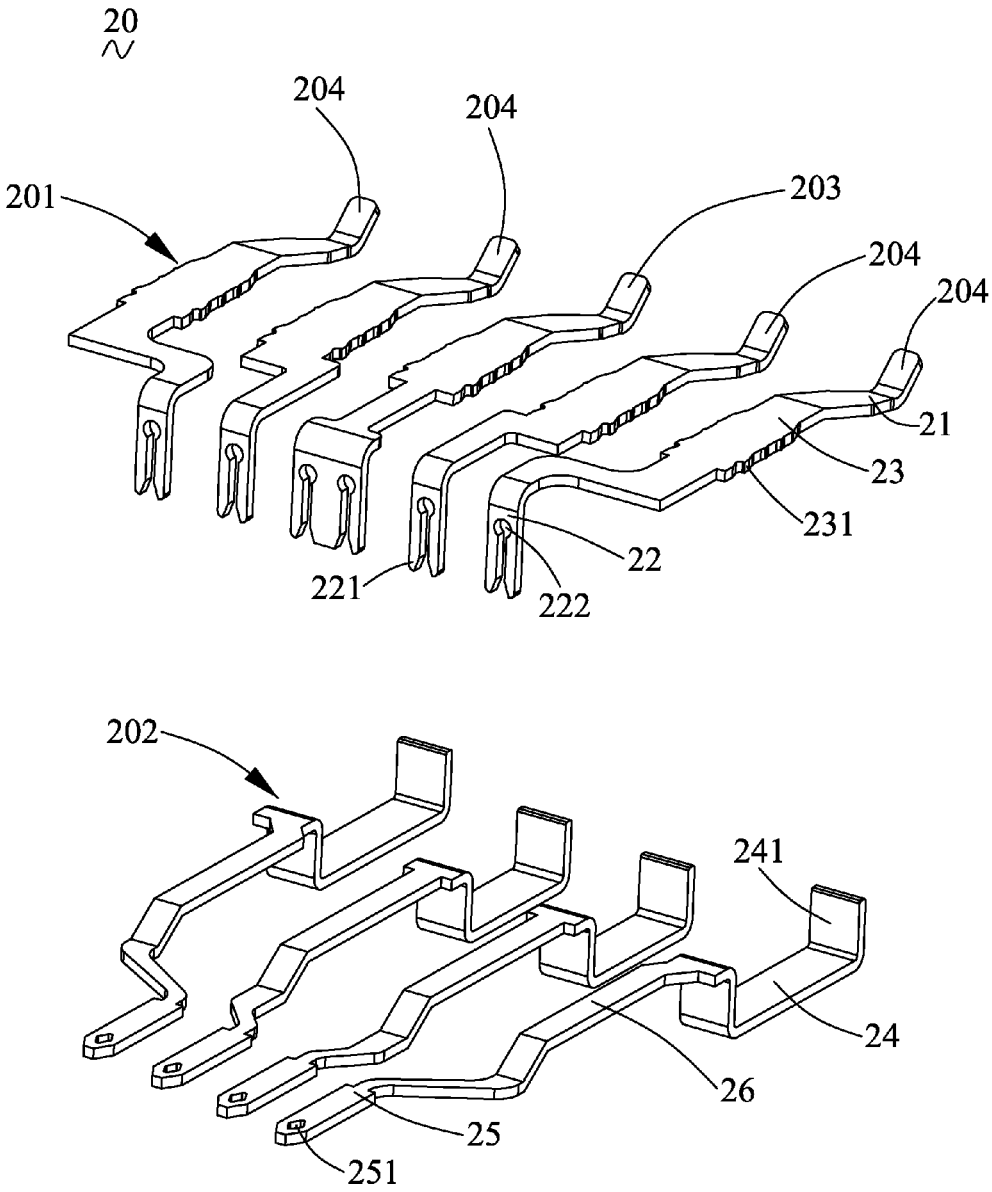
FIG. 6 is a perspective view of the conductive contacts shown in FIG. 2.

Please refer to FIG. 6 in conjunction with FIG. 3, the first contact 201 comprises a first contacting section 21 for electrically connecting with a complementary connector (not shown), a first termination section 22 exposed out of the rear edge of the insulative housing 10, and a first intermediate section 23 connecting the first contacting section 21 and the first termination section 22. The second contact 202 comprises a second contacting section 24 for electrically connecting with the complementary connector, a second termination section 25 exposed out of the rear edge of the insulative housing 10, and a second intermediate section 26 connecting the second contacting section 24 and the second termination section 25. The second contacting section 24 is of L-shape and comprises a longer flat section 240 and a shorter retaining section 241 bending downwardly from the flat section 240. The first termination section 22 extends rearwardly from the first intermediate section 23 to form a flat section, then bends downwardly to form a vertical section. The vertical section of the first termination section 22 is of fork shape and comprises a pair of latching pieces 221 and a receiving hole 222 formed at the junction of the flat section and the vertical section. The second termination section 25 defines a through hole 251 for accommodating soldering resin. Hence, the first termination section 22 connects with corresponding first wire 401 via Insulation Displacement Connection (IDC), while the second termination section 25 connects with corresponding wire 402 via solder connection.

The first contacts 201 and the second contacts 202 all comprise ground contacts and differential pairs. In detail, in the preferred embodiment of the present invention, the arrangement of the conductive contacts 20 fulfills the interface protocol of USB 3.0. The first contacts 201 comprise a first ground contact 203 and two pairs of first differential pair 204. The first termination section 22 of each differential pair contact 204 has the pair of latching pieces 221 and the receiving hole 222, thus a corresponding first wire 401 connects with each differential pair contact 204 via IDC for transmitting differential signal. The first termination section 22 of the ground contact 203 has three latching pieces 221 and a pair of receiving holes 222, thus a pair of first wires 401 connects with the ground contact 203 via IDC for grounding.

The first contacting section 21 is curved and elastic, while the second contacting section 24 is flat and non-elastic. The first contacting section 21 is closer to the main portion 11 of the insulative housing 10 than the second contacting section 24. Roughly, the free end of the first contacting section 21 is located behind a rear end of the second contacting section 24. In the preferred embodiment of the present invention, the first and second contacting sections 21, 24 are both located at the same side of the mating portion 12 and exposed to the outside. The first intermediate section 23 and the second intermediate section 26 are respectively located in different horizontal surfaces arranged along a thickness direction of the insulative housing 10. The first and second termination sections 22, 25 respectively bend from the first and second intermediate sections 23, 26 and locate in the same surface. The retaining sections 241 are respectively embedded in the mating portion 12, and the free ends of the retaining sections 241 are exposed into the recess 17 but not beyond the recess 17, thus, preventing the retaining sections 241 from contacting the outer shell 30 and being destroyed. The first intermediate section 23 forms a plurality of barbs 231 on opposite lateral sides thereof. Via the interferential engagement between the barbs 231 and the first receiving slots 13, the first contacts 201 are reliably retained in the first receiving slots 13.

Figure 7:
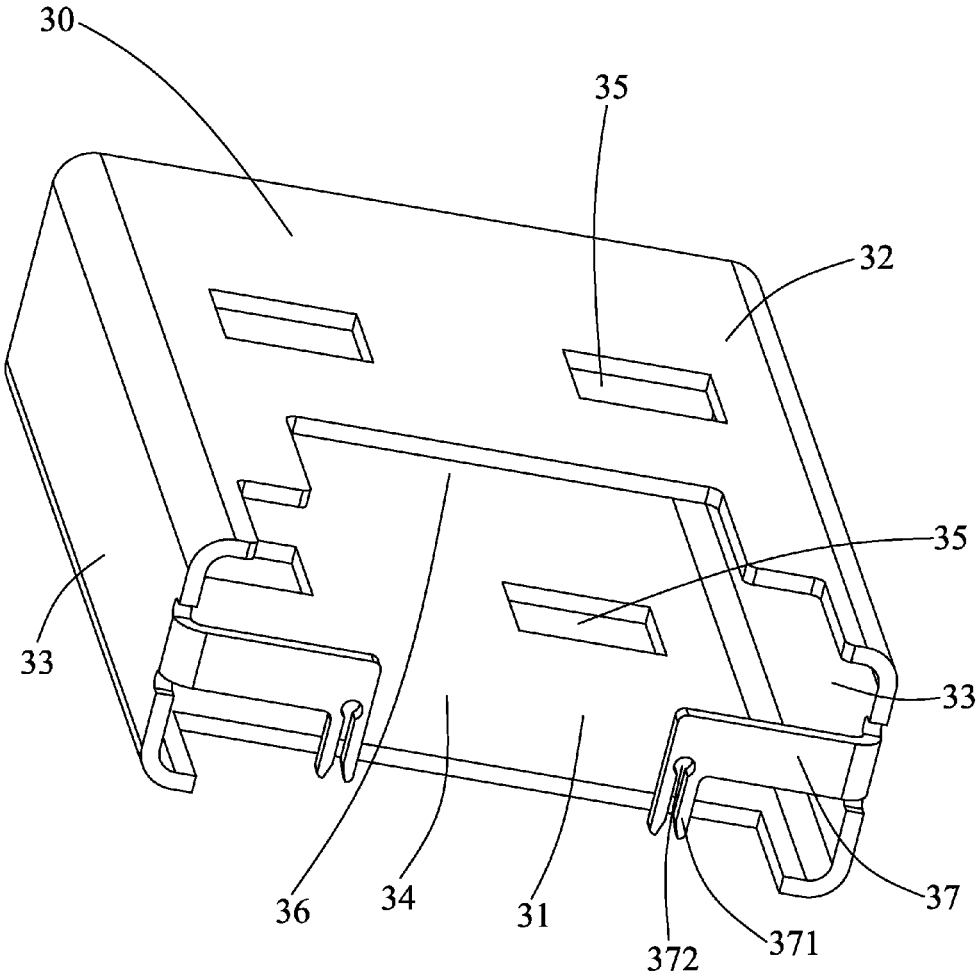
FIG. 7 is a perspective view of an outer shell of the cable connector assembly shown in FIG. 2.

Please refer to FIG. 7 in conjunction with FIG. 2, the outer shell 30 comprises an upper wall 31, a lower wall 32 opposite to the upper wall 31 and a pair of lateral walls 33 connecting the upper wall 31 and the lower wall 32. A receiving space 34 is defined by the upper wall 31, the lower wall 32, the lateral walls 33 and the insulative housing 10 for receiving the complementary connector. The upper wall 31 and the lower wall 32 respectively define a pair of latching notches 35 for cooperating with the complementary connector. The lower wall 32 forms a cutout 36 for interferentially receiving the protruding platform 18. Each lateral wall 33 forms an L-shape ear section 37 bending vertically from the lateral wall 33 toward the other lateral wall 33, with a horizontal section received in the notch 15 of the insulative housing 10. The vertical section of the ear section 37 forms a pair of second latching pieces 371 and a second receiving hole 372 at the junction of the pair of second latching pieces 371 for accommodating the third wire 403, thus, the third wires 403 and the outer shell 30 realize Insulation Displacement Connection (IDC) for ground.

In the preferred embodiment of the present invention, the first latching pieces 221 of the first termination sections 22 of the first contacts 201 and the second latching pieces 371 of the ear sections 37 of the outer shell 30 are located in one line and in the same surface with the first latching pieces 221 located between the pair of second latching pieces 371. Hence, the first wires 401 and the third wires 403 are arranged in a line and located in the same surface with the first wires 401 located between the pair of third wires 403. Via the cooperation between the protruding platform 18 and the cutout 36, and the cooperation between the notches 15 and the ear sections 37, the insulative housing 10 is prevented from being moved relative to the outer shell 30 along the length direction, the width direction and the height direction of the cable connector assembly 100, hence enhancing the stable electrical connection between the cable connector assembly 100 and the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A cable connector assembly, comprising:

an insulative housing comprising a main portion and a mating portion extending forwardly from the main portion;

a plurality of conductive contacts received in the insulative housing and comprising a plurality of first contacts and a plurality of second contacts, each first contact comprising a first contacting section adapted for electrically connecting with a complementary connector and a first termination section exposed beyond the insulative housing, each second contact comprising a second contacting section adapted for electrically connecting with the complementary connector and a second termination section exposed beyond the insulative housing;

a plurality of first wires electrically connecting with the first contacts, and the first termination section of the first contact electrically connecting with corresponding first wire via Insulation Displacement Connection (IDC); and a plurality of second wires electrically connecting with the second contacts, and the second termination section of the second contact electrically connecting with corresponding second wire via soldering.

2. The cable connector assembly as claimed in claim 1, wherein the free end of the first contacting section of the first contact is behind a rear end of the second contacting section of the second contact.

3. The cable connector assembly as claimed in claim 2, wherein each second contacting section of the second contact is of L-shape and comprises a flat section embedded in the insulative housing and a retaining section bending vertically from the flat section.

4. The cable connector assembly as claimed in claim 1, wherein the insulative housing defines a plurality of first receiving slots to receive the first contacts, and a plurality of second receiving slots to receive the second contacts, wherein the first receiving slots and the second receiving slots are arranged alternatively.

5. The cable connector assembly as claimed in claim 1, wherein the first and second contacting sections of the first and second contacts are located at the same side of the mating portion of the insulative housing and exposed to the outside.

6. The cable connector assembly as claimed in claim 5, wherein the first contacting section is curved and elastic, and the second contacting section is flat and non-elastic, wherein the first contacting section is located closer to the main portion of the insulative housing than the second contacting section.

7. The cable connector assembly as claimed in claim 1, wherein the first contact comprises a first intermediate section connecting the first contacting section and the first termination section, and the second contact comprises a second intermediate section connecting the second contacting section and the second termination section, wherein the first and second intermediate sections are located in different horizontal surfaces arranged along a thickness direction of the insulative housing.

8. The cable connector assembly as claimed in claim 7, wherein the first and second termination sections bend from respective first and second intermediate sections and are located in the same surface.

9. The cable connector assembly as claimed in claim 1, wherein the first contacts comprise a first ground contact and two pairs of first differential pair, and the second contacts comprise a pair of second ground contacts and one pair of second differential pair.

10. The cable connector assembly as claimed in claim 1, further comprising an outer shell enclosing the insulative housing and conductive contacts.

11. The cable connector assembly as claimed in claim 10, wherein the outer shell comprises an upper wall, a lower wall and a pair of opposite walls connecting the upper and lower walls, wherein the first and second contacting sections of the first and second contacts face to the upper wall.

12. The cable connector assembly as claimed in claim 11, wherein each lateral wall forms an ear section extending vertically from a rear edge thereof, and wherein the main portion of the insulative housing forms a pair of notches to receive the ear sections.

13. The cable connector assembly as claimed in claim 12, wherein the wires further comprise a pair of third wires, and wherein each ear section electrically connects with corresponding third wire.

14. The cable connector assembly as claimed in claim 13, wherein each ear section forms a pair of latching pieces and a receiving hole to accommodate the third wire in IDC connection.

15. The cable connector assembly as claimed in claim 13, wherein the pair of third wires is ground wires, and the first wires are located between the pair of third wires.

* * * * *